US008079728B2

(12) United States Patent
James, Sr. et al.

(10) Patent No.: US 8,079,728 B2
(45) Date of Patent: Dec. 20, 2011

(54) INDICATOR TEST SWITCH FOR DOWNLIGHT LIGHTING DEVICE AND BRACKET THEREFOR

(75) Inventors: Malcolm D. James, Sr., Spartanburg, SC (US); Shawn A. Wilcox, Greenville, SC (US); Conley L. McGee, Simpsonville, SC (US); Carl W. Wilson, Lyman, SC (US); Ronald C. Newbold, Jr., Roebuck, SC (US)

(73) Assignee: Hubbell Incorporated, Shelton, CT (US)

( * ) Notice: Subject to any disclaimer, the term of this patent is extended or adjusted under 35 U.S.C. 154(b) by 702 days.

(21) Appl. No.: 12/219,066

(22) Filed: Jul. 15, 2008

(65) Prior Publication Data

US 2010/0013392 A1 Jan. 21, 2010

(51) Int. Cl.
*F21V 1/00* (2006.01)

(52) U.S. Cl. ..... 362/217.08; 362/217.12; 362/217.14; 362/650; 315/72; 315/86; 340/652; 340/656; 324/414; 324/419

(58) Field of Classification Search ..... 362/217.08, 362/217.12, 217.14, 217.16, 221, 647, 650, 362/657, 217.05; 315/56–58, 65, 72, 86; 340/636.2, 651–654, 656; 324/414, 415, 324/419

See application file for complete search history.

(56) References Cited

U.S. PATENT DOCUMENTS

| | | | | |
|---|---|---|---|---|
| 4,144,462 | A * | 3/1979 | Sieron et al. | 307/66 |
| 5,088,015 | A * | 2/1992 | Baggio et al. | 362/657 |
| 5,323,116 | A * | 6/1994 | Atria | 324/511 |
| 6,979,097 | B2 * | 12/2005 | Elam et al. | 362/148 |

* cited by examiner

*Primary Examiner* — Haiss Philogene

(74) *Attorney, Agent, or Firm* — Kevin M. Barner; Mark S. Bicks; Alfred N. Goodman

(57) ABSTRACT

A lighting device including a test device for testing the proper operation of a primary and a secondary power supply alternatively providing electrical power to the light. The test device is attached to a bracket using a single fastener such as a nut and the bracket is attached to a receptacle for the light using a different single fastener, such as a pop-rivet or screw.

17 Claims, 6 Drawing Sheets

INDICATOR TEST SWITCH FOR DOWNLIGHT LIGHTING DEVICE AND BRACKET THEREFOR

FIELD OF THE INVENTION

This invention relates generally to an improved device for testing the proper operation of a lighting fixture and the power source supplying the lighting fixture with power. More particularly, the present invention is directed to an assembly including an indicator test switch (ITS) attached to a bracket that is attached to the inside surface of a socket cup of a fluorescent lighting fixture.

BACKGROUND OF THE INVENTION

Various devices and methods for ensuring proper and continuous operation of lighting fixtures and the power sources that supply power to the lighting fixtures are well known. For example, it is known to connect a fluorescent lighting fixture to an emergency, or backup, power system in addition to a primary power system so the light will remain powered in the event of a failure of the primary power source. It is further known to provide a mechanism to test the proper operation of both the emergency power source as well as the operation of the light when powered by the emergency power source.

One such known device is illustrated in FIG. 6. The device shown in FIG. 6 is for testing a lighting fixture, such as linear fluorescent lighting fixture 600, that has a primary power source (not shown) and a secondary power source (not shown) that is switched-in to provide power to the linear lamps 610 if the primary power source fails. The test device 620 shown in FIG. 6 includes a push-button switch that is connected to both the primary power source and the secondary power source. When the button on the switch is pressed, the primary power source is electrically disconnected from the lighting fixture and the emergency power source is electrically connected. If the emergency power source is operating properly, the light will illuminate.

Additionally, in accordance with this known device, an indicator light, such as a Light Emitting Diode (LED), is also provided in the switch. The LED is wired within the device to illuminate whenever the emergency ballast battery is charging. Thus, by observing the illuminated LED, a user is informed whether the backup emergency battery is charging. Further, when the button is pushed on the switch, the main light will either illuminate or not, thus indicating whether the lighting fixture is properly connected to the emergency power source.

The device described above and shown in FIG. 6, however, is problematic at least because it mounts on the outside of the lighting fixture, is difficult to install and is unattractive.

SUMMARY OF THE INVENTION

Illustrative, non-limiting embodiments of the present invention overcome the aforementioned and other disadvantages associated with related art test switches for fluorescent lighting fixtures. Also, the present invention is not required to overcome the disadvantages described above and an illustrative non-limiting embodiment of the present invention may not overcome any of the problems described above.

More particularly, to address the above-mentioned issues related to conventional methods and devices for testing the proper operation and connection of fluorescent lighting power sources a lighting device is proposed that includes a socket operable to electrically connect an illuminating device to a primary power source, a test device operable to electrically disconnect the primary power source from the illuminating device and electrically connect a secondary power source to the illuminating device and a bracket operable to support said test device.

In accordance with a further embodiment, the bracket included in the lighting device described above is attached to the socket using a single fastener, such as a rivet or a screw, and is located on the inner surface of the socket. Accordingly, the bracket, with the test switch supported thereby, is not as readily observed by a person nearby the lighting fixture. The bracket and switch are even less observable when a reflector device is attached to the socket and substantially envelopes the bracket and switch.

As used herein "substantially", "generally", and other words of degree, are used as a relative modifier intended to indicate permissible variation from the characteristic so modified. It is not intended to be limited to the absolute value or characteristic which it modifies but rather approaching or approximating such a physical or functional characteristic.

BRIEF DESCRIPTION OF THE DRAWINGS

The aspects of the present invention will become more readily apparent by describing in detail illustrative, non-limiting embodiments thereof with reference to the accompanying drawings, in which.

DETAILED DESCRIPTION OF ILLUSTRATIVE, NON-LIMITING EMBODIMENTS

Exemplary, non-limiting, embodiments of the present invention are discussed in detail below. While specific configurations and dimensions are discussed to provide a clear understanding of the invention, it should be understood that any disclosed dimensions and configurations are provided for illustration purposes only. A person skilled in the relevant art will recognize that other dimensions and configurations may be used without departing from the spirit and scope of the invention.

Figure 1:
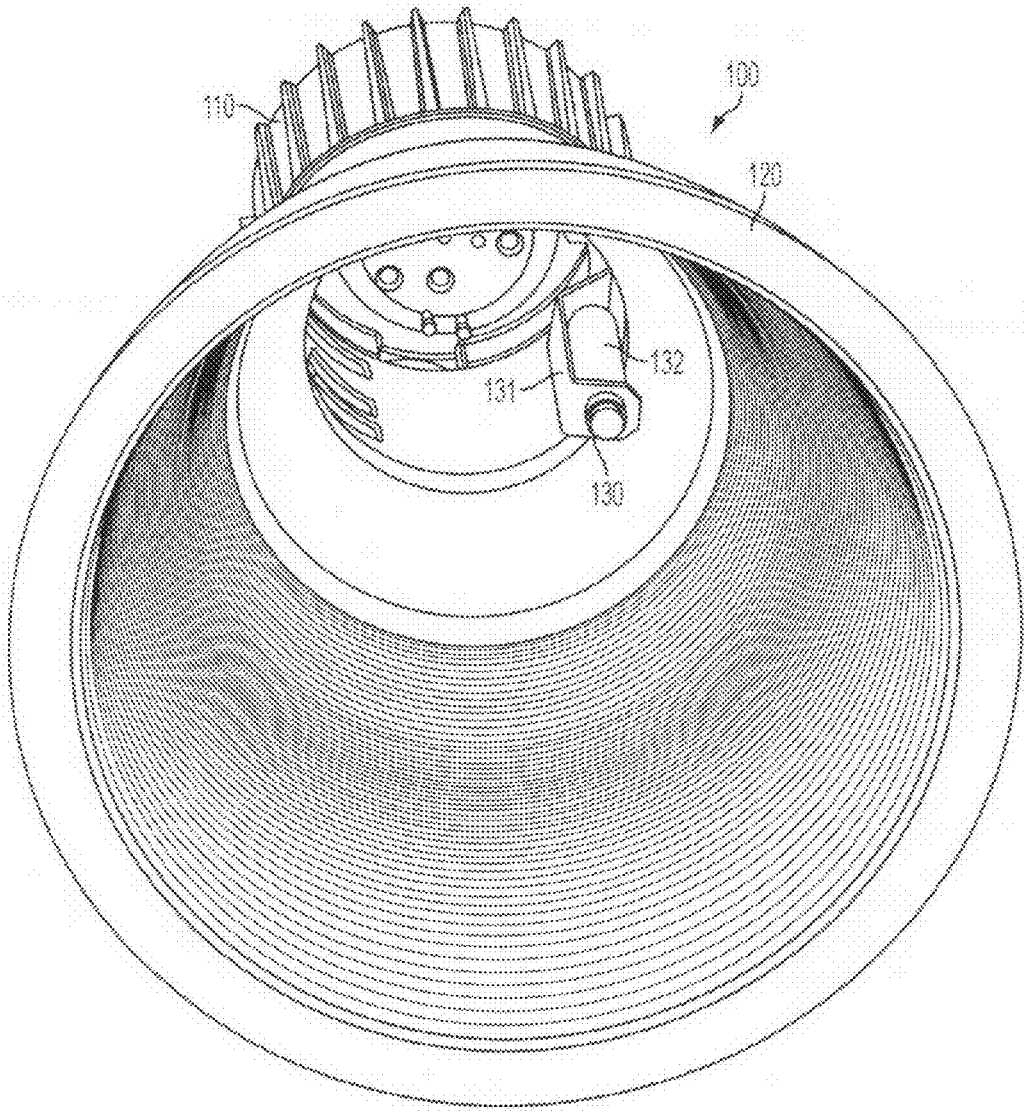
FIG. 1 is a perspective view showing a test switch and bracket attached to the inner surface of a socket cup having a reflector attached thereto in accordance with the present invention.
Figure 5:
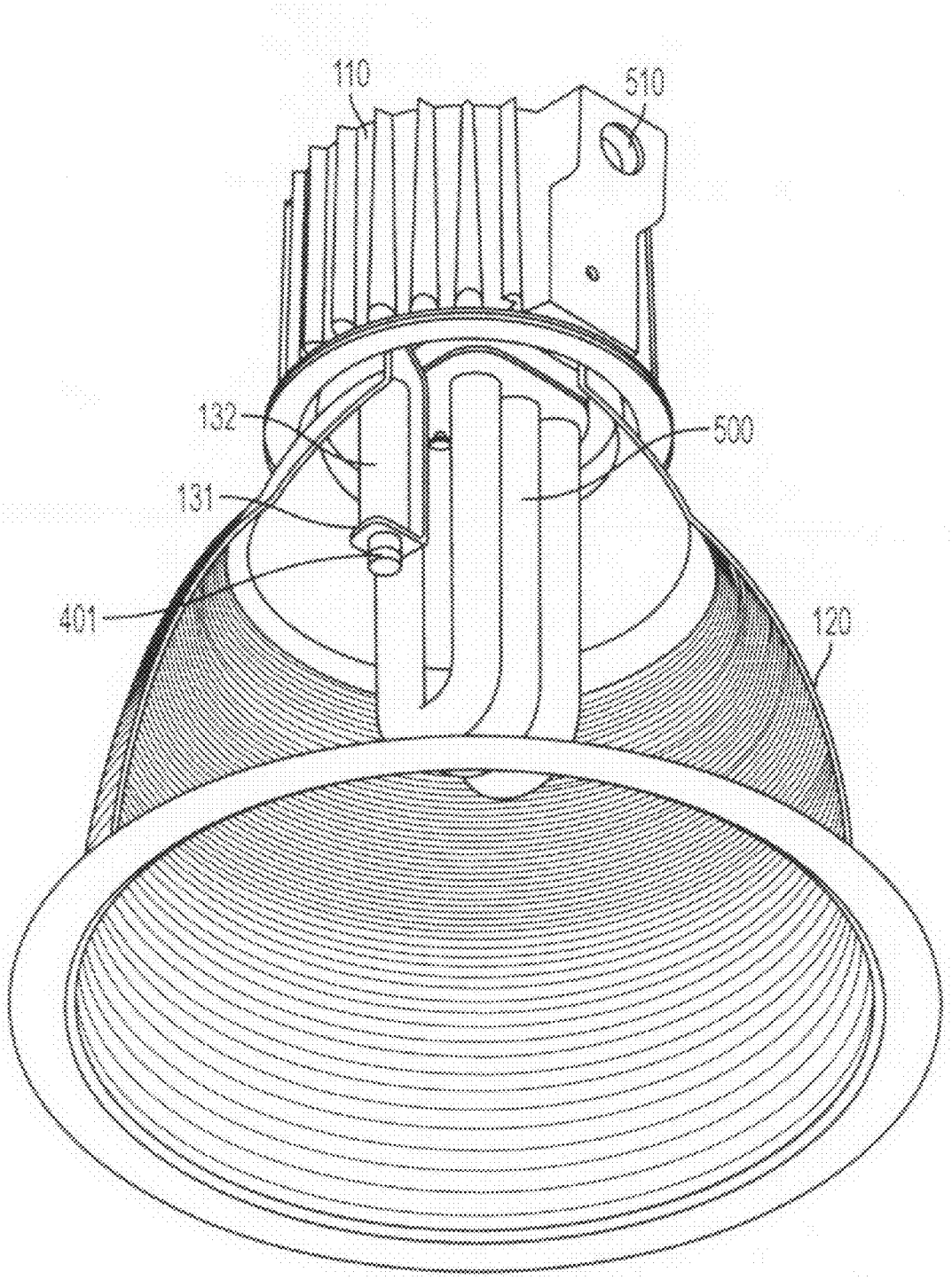
FIG. 5 is a cutaway perspective view of a lighting device with a fluorescent lamp installed in a socket that further has a bracket and test switch installed in accordance with the present invention.
Figure 6:
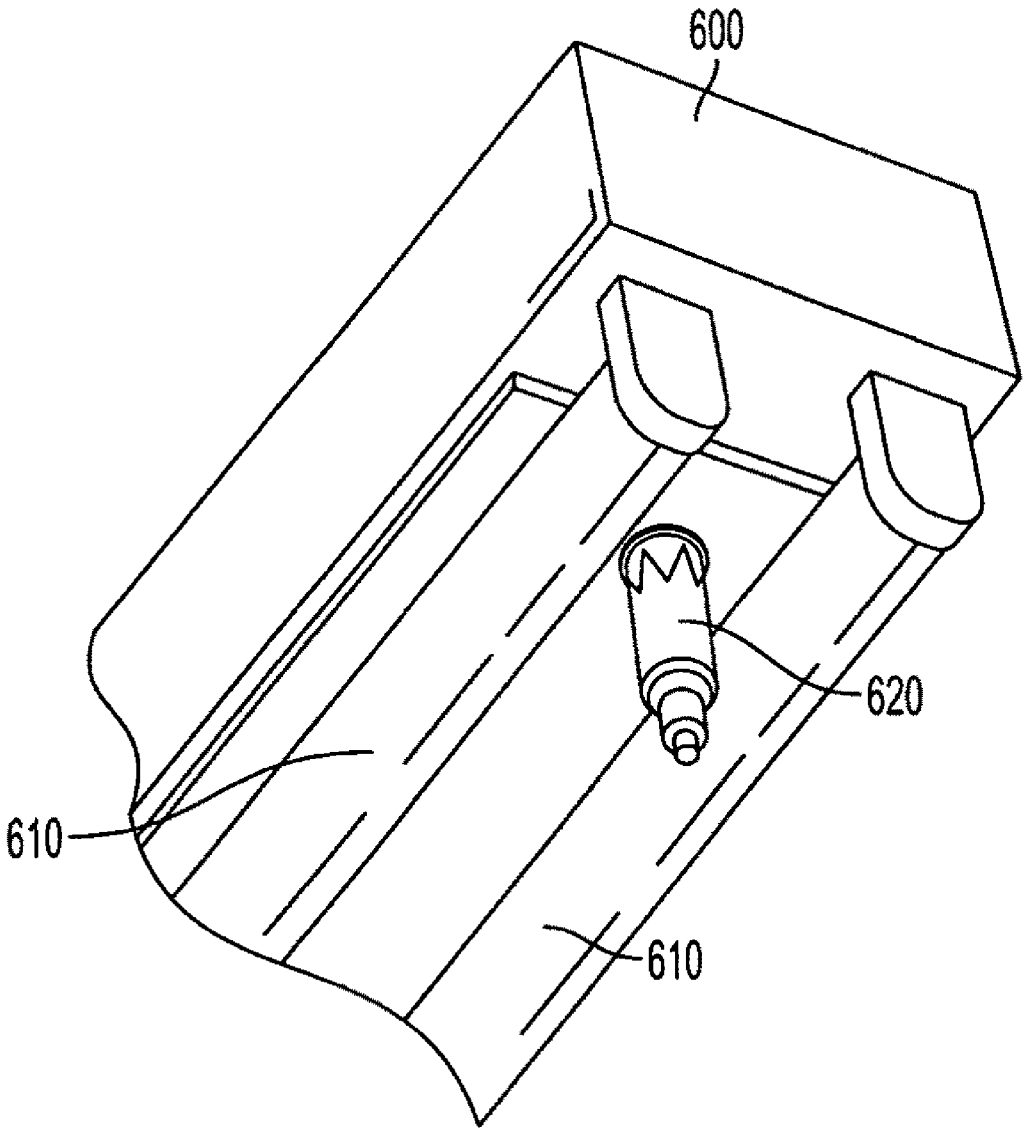
FIG. 6 PRIOR ART
FIG. 6 is a perspective view showing a test switch attached to the outside surface of a housing fixture of a fluorescent lighting device in accordance with the prior art.

FIGS. 1 and 5 illustrate an exemplary embodiment of a lighting device 100 having a test switch 132 for testing the proper operation of the fluorescent lighting device 100 according to the invention. Lighting device 100 is installed in residential and commercial buildings according to standard practices for providing light to a specified area. An optional reflector 120 is attached to the socket cup 110 and surrounds the fluorescent lamp 500 (FIG. 5) to reflect the light from the lamp 500 in specific desired directions. Bracket assembly 130 is also attached to socket cup 110, as described in more detail below, and includes bracket 131 and test switch 132.

Figure 2:
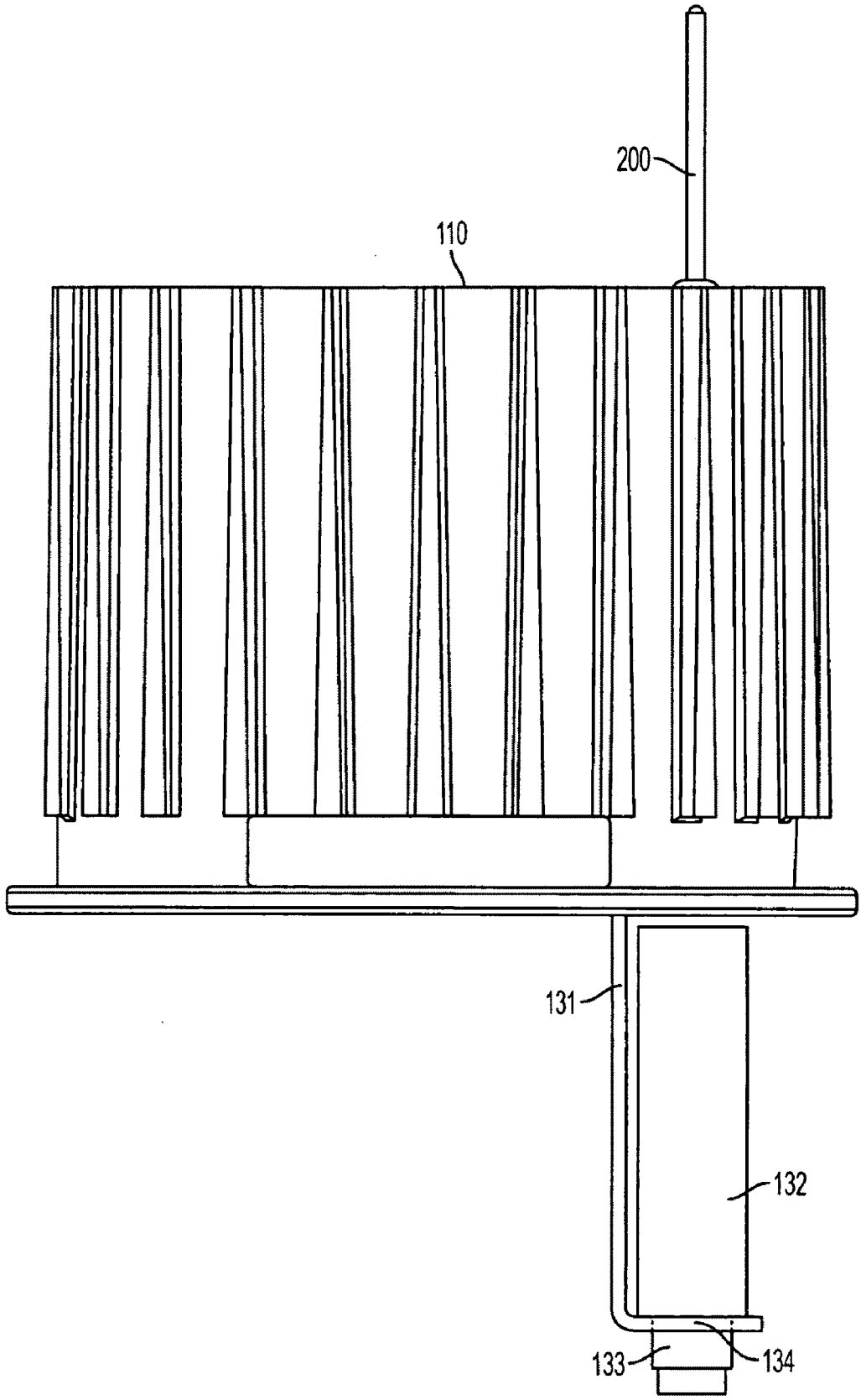
FIG. 2 is a side view of a socket cup for a fluorescent lighting device with a test switch and bracket installed in accordance with the present invention.
Figure 3:
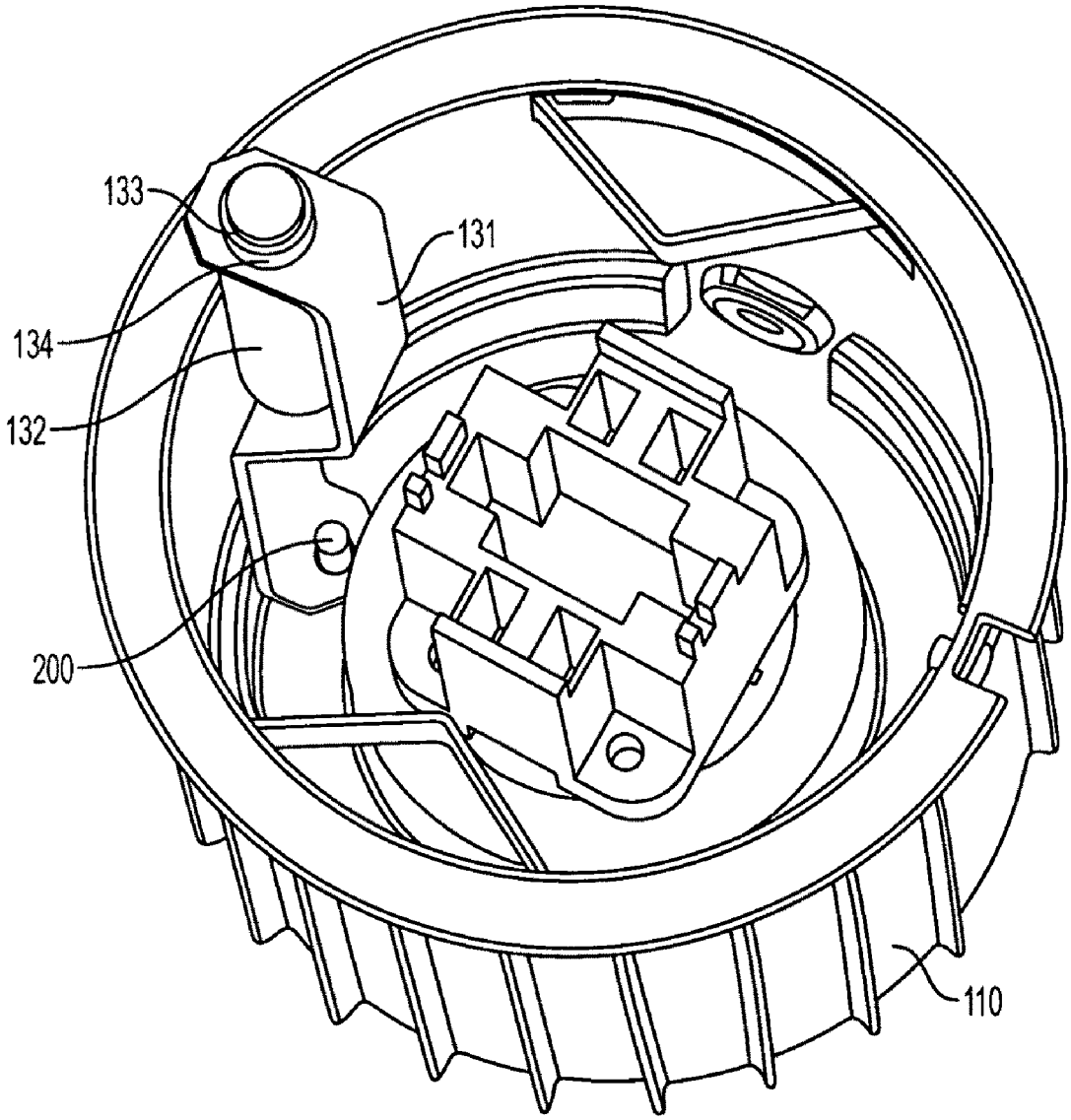
FIG. 3 is a close-up perspective view showing a bracket and test switch attached to the inner surface of a socket cup for a fluorescent lighting device using a single fastener in accordance with the present invention.

FIG. 2 is a side view of socket cup 110 of the exemplary embodiment shown in FIG. 1 with bracket 131 and switch 132 installed and FIG. 3 is a perspective view showing the same device as shown in FIG. 2 looking into the socket cup 110. More particularly, bracket 131 is attached to the back side of socket cup 110 using a single fastener, such as pop rivet 200. Although pop rivet 200 is a convenient way to semi-permanently attach bracket 131 to the socket cup and keep it from moving once installed, one skilled in the art would understand that other fastening methods, such as soldering, welding, screwing or using some type of adhesive, could also be used to attach the bracket to the socket cup. Referring to both FIGS. 2 and 3, a portion of bracket 131 is located within the socket cup 110 where it is attached to the inner surface of the cup at rivet 200, and another portion of the bracket, the portion to which test switch 132 is attached and more clearly seen in FIG. 2, extends out beyond socket cup 110.

Switch 132 is attached to bracket 131 at the portion of the bracket extending outside of socket 110 using a single fastening device, such as a nut 133 threaded onto a threaded portion of the switch (not shown) that passes through a hole 134 in bracket 131. Also, the portion of bracket 131 to which the switch 132 is attached is L-shaped and faces outward from the socket cup. Accordingly, the test switch 132 is accessible after the lamp 500 (FIG. 5) is installed in socket 110.

Figure 4:
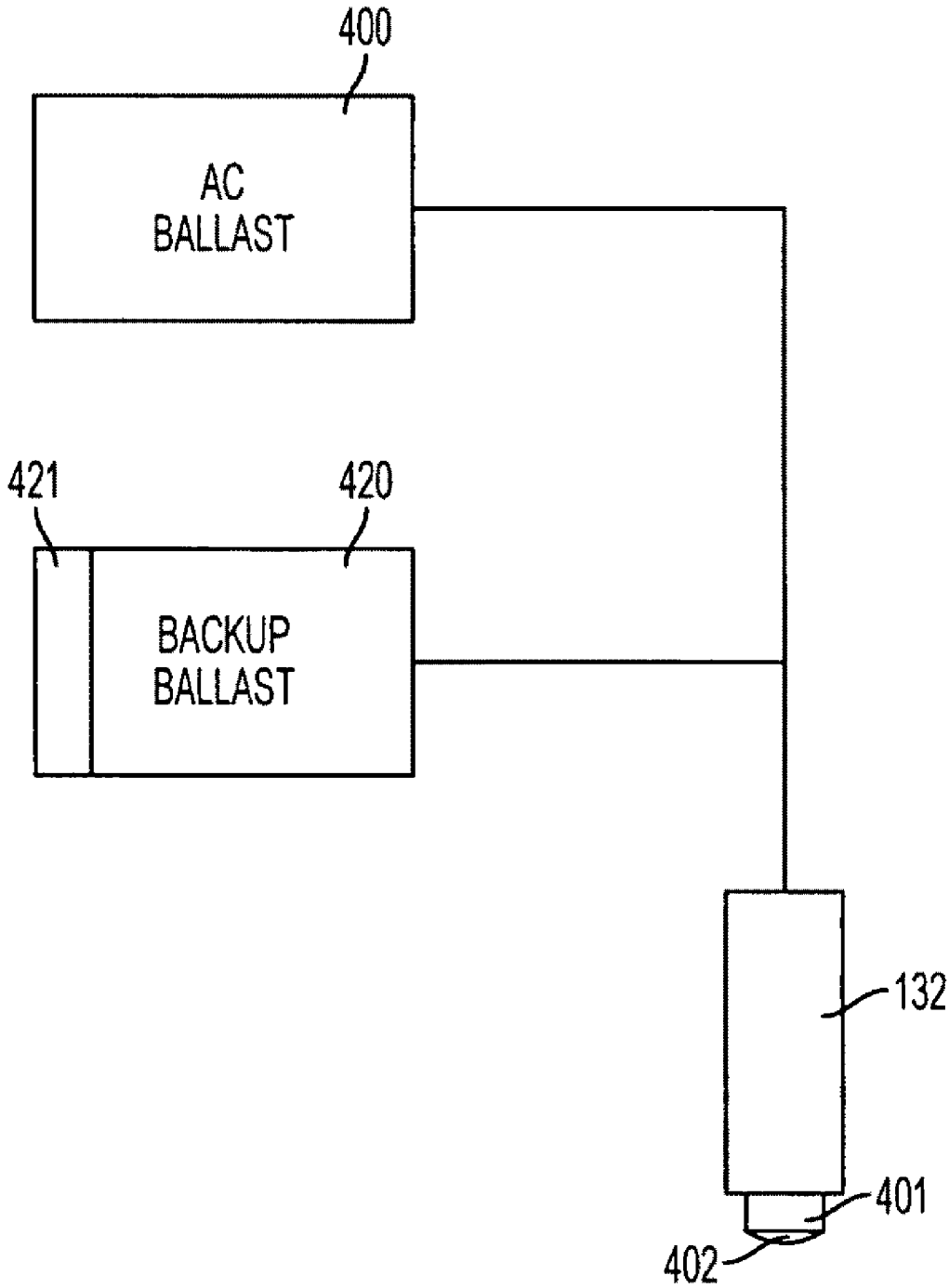
FIG. 4 is a block diagram showing the connections between a switch and the power sources for a lighting device in accordance with the present invention.

FIG. 4 illustrates generally how switch 132 from FIGS. 1-3 and 5 is connected to a primary and secondary power source. In particular, switch 132 is a test switch, for example, with a push-button actuator 401. Switch 132 is electrically connected to both a primary power source 400, such as an AC ballast for providing power to a fluorescent lamp, and a back-up power source, such as back-up ballast 420. Back-up ballast 420, for example, includes a battery and optionally a battery-charging device. Under normal conditions AC ballast 400 continuously provides regulated AC current to the socket cup 110 (FIGS. 1-3) which, in turn, provides electrical current to a lamp installed in the socket. Back-up ballast 420 is also electrically connected to socket cup 110 but only provides power to socket cup 110 when AC ballast 400 fails or when switch 132 is activated to connect the backup power supply to the lighting device instead of the primary power source.

For example, when actuator 401 is pressed, or otherwise actuated, AC ballast 400 is electrically disconnected from the socket and back-up ballast 420 is electrically connected to the socket. Accordingly, by actuating switch 132 it is possible to test the proper operation and connection of a back-up power supply. Specifically, with a lamp installed in the socket, if the back-up power supply is connected and operating properly, when switch 132 is actuated the lamp should illuminate because it is being powered by the back-up power supply.

In accordance with a further embodiment, as shown in FIG. 4 switch 132 also includes an indicator 402. Indicator 402 ideally is a light, such as an LED, that illuminates when back-up ballast 420 is charging. For example, back-up ballast 420 comprises a battery 421, or batteries, that are constantly charging to maintain a reliable back-up power source. Indicator 402 indicates whether or not the charging system of battery 421 is operating properly to provide the needed charge.

While various aspects of the present invention have been particularly shown and described with reference to the exemplary, non-limiting, embodiments above, it will be understood by those skilled in the art that various additional aspects and embodiments may be contemplated without departing from the spirit and scope of the present invention. For example, bracket 132, as shown in FIGS. 1-3 can be made of any suitable material, such as steel, aluminum, or other metal, or heat-resistant plastic. Also, the bracket does not necessarily have to be shaped as shown in the exemplary embodiments.

It would be understood that a device or method incorporating any of the additional or alternative details mentioned above would fall within the scope of the present invention as determined based upon the claims below and any equivalents thereof.

Other aspects, objects and advantages of the present invention can be obtained from a study of the drawings, the disclosure and the appended claims.

What is claimed is:

1. A lighting device comprising:

a socket operable to electrically connect an illuminating device to a primary power source;

a test device operable to electrically disconnect the primary power source from the illuminating device and electrically connect a secondary power source to the illuminating device; and a bracket operable to support said test device wherein said bracket is attached to said socket at an inside surface of said socket.

2. The lighting device claimed in claim 1, wherein said bracket is attached to said socket with a single fastening device.

3. The lighting device claimed in claim 1, wherein the illuminating device is a fluorescent lamp.

4. The lighting device claimed in claim 1, further comprising an indicator operable to indicate whether the secondary power source is functioning during a time when the secondary power source is not providing power to the illuminating device.

5. The lighting device claimed in claim 1, wherein the primary power source is an AC ballast and the secondary power source is a battery.

6. The lighting device claimed in claim 2, wherein said single fastening device is one of a pop-rivet and a screw.

7. The lighting device claimed in claim 2, wherein said test device is attached to said bracket using a threaded nut.

8. A lighting system comprising:

a receptacle device e to receive a fluorescent lamp;

a primary power supply operable to provide electrical power to said receptacle device;

a secondary power supply operable to provide electrical power to said receptacle device;

a bracket attached to an inside surface of said receptacle device; and a test device attached to said bracket, wherein said bracket and said test device are both located inside an outermost dimension of said receptacle device.

9. The lighting device claimed in claim 8, wherein said test device is electrically connected to both of said primary and secondary power supplies and is operable to selectively electrically connect said primary power supply or said secondary power supply to said receptacle device.

10. The lighting device claimed in claim 8, further comprising at least one U-shaped fluorescent lamp electrically connected to said receptacle device.

11. The lighting device claimed in claim 10, further comprising a reflector device detachably connected to said receptacle device and operable to reflect light downwardly from said at least one U-shaped fluorescent lamp.

12. The lighting device claimed in claim 8, wherein said bracket is mechanically attached to said receptacle device using a single fastening device.

13. The lighting device claimed in claim 12, wherein said test device is mechanically attached to said bracket at an end of said bracket distal from an end of said bracket attached to said receptacle device.

14. The lighting device claimed in claim 11, wherein said bracket and said test device are disposed between said at least one U-shaped fluorescent lamp and said reflector device.

15. The lighting device claimed in claim 14, wherein said bracket and said test device are substantially enclosed within a space created by the inner surface of said receptacle device and said reflector device.

16. The lighting device claimed in claim 9, wherein said test device comprises an indicator device operable to indicate whether said secondary power supply is electrically connected to a main power supply, said main power supply being operable to provide electrical current to both said primary power supply and said secondary power supply.

17. The lighting device claimed in claim 16, wherein said secondary power supply includes a battery and the indicator of said test device is operable to indicate whether the battery is charging.

* * * * *